US006896136B2

(12) United States Patent
Hu

(10) Patent No.: US 6,896,136 B2
(45) Date of Patent: May 24, 2005

(54) TOOL RACK HAVING TWO STORIES OF RACK MEMBERS

(76) Inventor: Bobby Hu, 8F, No. 536~1,Ta Chin Street, Taichung (TW)

( * ) Notice: Subject to any disclaimer, the term of this patent is extended or adjusted under 35 U.S.C. 154(b) by 45 days.

(21) Appl. No.: 10/436,414

(22) Filed: May 13, 2003

(65) Prior Publication Data

US 2003/0234196 A1 Dec. 25, 2003

(30) Foreign Application Priority Data

Jun. 21, 2002 (TW) ..... 91113822 A

(51) Int. Cl.[7] ..... B65D 85/20

(52) U.S. Cl. ..... 206/378; 206/372; 206/376; 211/70.6

(58) Field of Search ..... 206/372, 373, 206/376, 377, 378; 211/70.6, 70.7, 168, 169

(56) References Cited

U.S. PATENT DOCUMENTS 3,878,939 A * 4/1975 Wilcox ..... 206/373
4,819,800 A * 4/1989 Wilson ..... 206/373
4,997,085 A * 3/1991 Brennan ..... 206/376
5,855,274 A * 1/1999 Piao ..... 206/373
6,068,123 A * 5/2000 Chen ..... 206/373
6,257,409 B1 * 7/2001 Lin ..... 206/376
6,315,121 B1 * 11/2001 Hansen ..... 206/376
6,679,391 B1 * 1/2004 Huang ..... 211/70.6

* cited by examiner

*Primary Examiner*—John A. Ricci
(74) *Attorney, Agent, or Firm*—Alan D. Kamrath; Nikolai & Mersereau, P.A.

(57) ABSTRACT

A tool rack includes a first rack member and a second rack member. The first rack member includes at least one tool-holding portion on a side thereof. The tool-holding portion of the first rack member releasably holds a tool. The second rack member includes an end pivotally engaged with an end of the first rack member. The second rack member includes at least one tool-holding portion on a side thereof. The tool-holding portion of the second rack member releasably holds a tool. The second rack member can be pivoted to a position allowing easy storage/retrieval of the tools in/from the first rack member.

20 Claims, 5 Drawing Sheets

TOOL RACK HAVING TWO STORIES OF RACK MEMBERS

BACKGROUND OF THE INVENTION

1. Field of the Invention

The present invention relates to a tool rack having two stories of rack members. In particular, the present invention relates to a tool rack having two rack members arranged in two stories.

2. Description of the Related Art

Taiwan Patent Publication No. 319154 discloses a tool rack including a board having a plurality of tool-holding members provided on a side of the board. Each tool-holding member includes a vertical through-hole. An opening is defined in a front side of the respective tool-holding member and communicated with the vertical through-hole. Thus, two substantially L-shaped resilient members are formed for the respective tool-holding member. The tool-holding members are designed to hold tools of different sizes. However, the tool-holding members are arranged in a row and thus occupy a considerable area, which adversely reduces the space for displaying the other tools while displaying the tools on the tool rack. The tool rack of a considerable overall area also causes an increase in the cost and is not easy to carry. Further, the cost for transportation is increased.

SUMMARY OF THE INVENTION

An object of the present invention is to provide a tool rack that has two rack members arranged in two stories, thereby reducing the overall area of the tool rack without reducing the number of the tools to be held by the tool rack.

A tool rack in accordance with the present invention includes a first rack member and a second rack member. The first rack member includes at least one tool-holding portion on a side thereof. The tool-holding portion of the first rack member releasably holds a tool. The second rack member includes an end pivotally engaged with an end of the first rack member. The second rack member includes at least one tool-holding portion on a side thereof. The tool-holding portion of the second rack member releasably holds a tool.

In an embodiment of the invention, the end of the first rack member includes a pivotal portion having a pivot hole that is partially exposed. Further, the other end of the first rack member includes a groove, and wherein the other end of the second rack member includes a hook that is releasably engaged in the groove of the first rack member. The hook of the second rack member can be disengaged from the groove of the first rack member and the second rack member can be pivoted to a position allowing easy storage/retrieval of the tools in/from the first rack member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
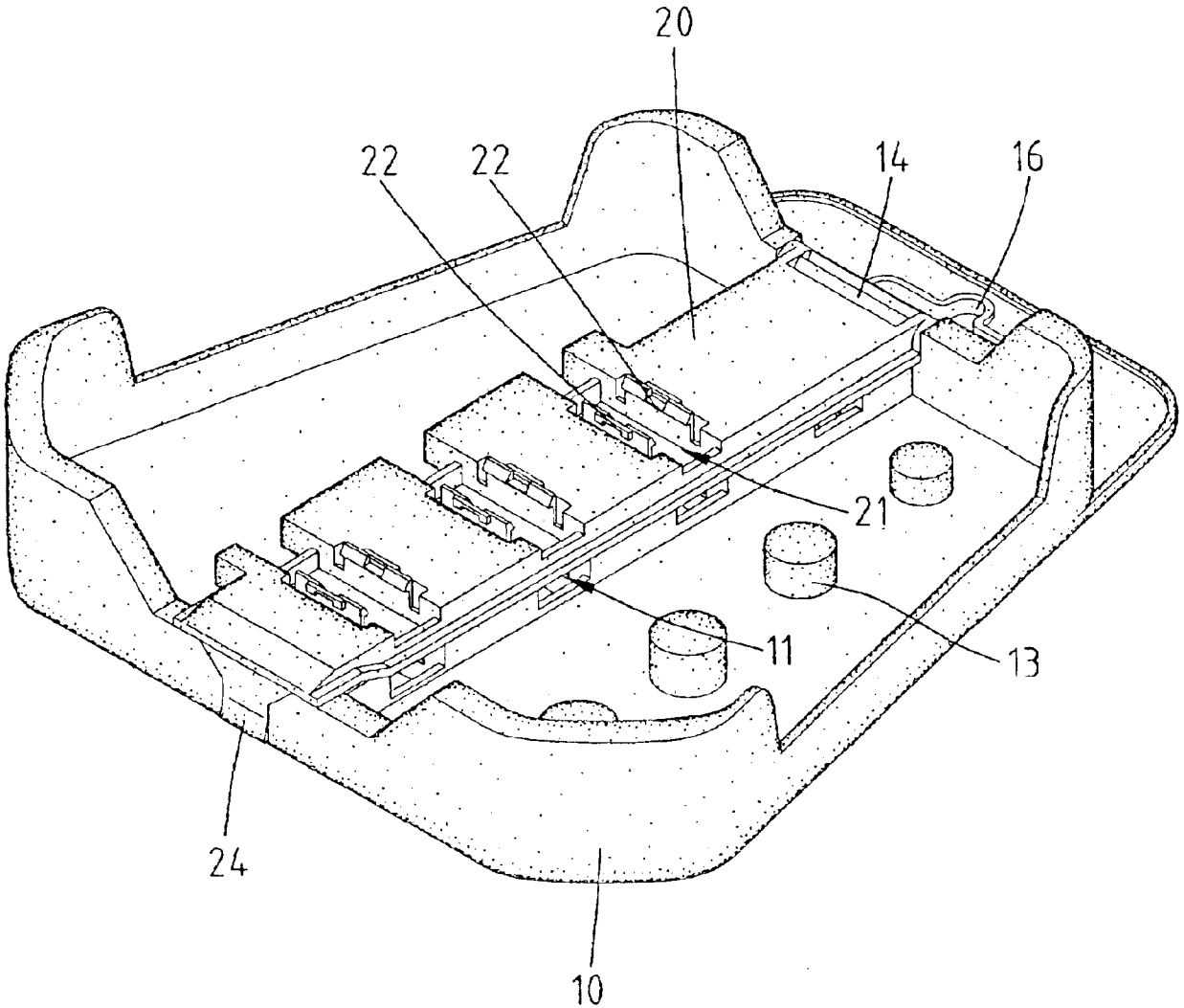
FIG. 1 is a perspective view of a tool rack in accordance with the present invention.
Figure 2:
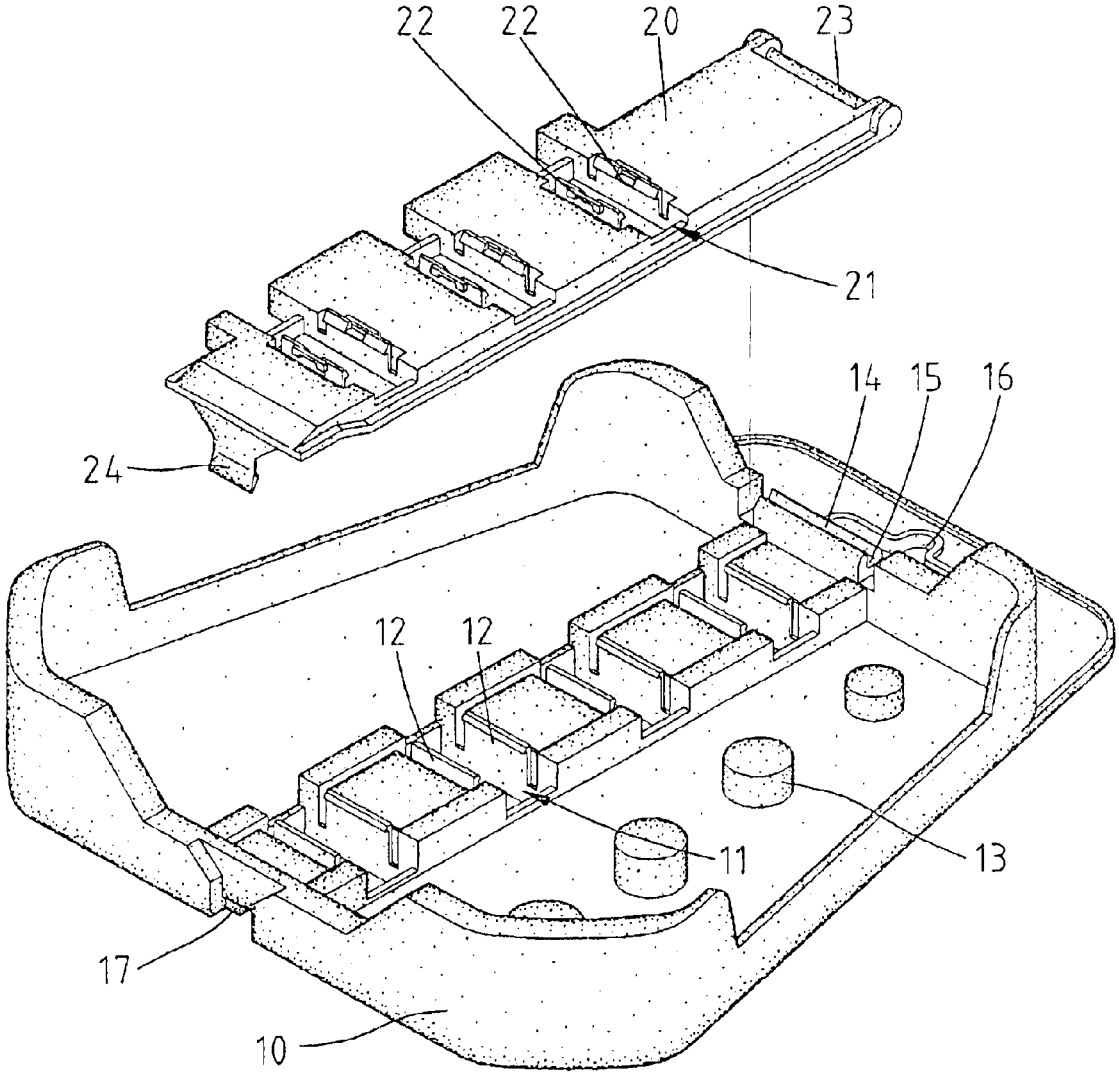
FIG. 2 is an exploded perspective view of the tool rack in accordance with the present invention.

Referring to FIGS. 1 and 2, a tool rack in accordance with the present invention generally comprises a first rack member 10 and a second rack member 20. The first rack member 10 includes a plurality of tool-holding portions 11 on a side thereof. In this embodiment, each tool-holding portion 11 includes two resilient tool-holding members 12 that are symmetrically arranged on the side of the first rack member 10. The side of the first rack member 10 further includes a plurality of positioning members 13 respectively aligning with the tool-holding portions 11. The first rack member 10 further includes a pivotal portion 14 on an end thereof. In this embodiment, the pivotal portion 14 includes a pivot hole 15 that is partially exposed. Further, the first rack member 10 has a hanger hole 16, allowing the first rack member 10 to be hung on a desired position.

The second rack member 20 includes a pin 23 formed on a first end thereof and a hook 24 on a second end thereof. The pin 23 is pivotally received in the pivot hole 15 of the first rack member 10. The hook 24 is releasably engaged with a notch or groove 17 defined in the other end of the first rack member 10. The second rack member 20 further includes a plurality of tool-holding portions 21 on a side thereof In this embodiment, each tool-holding portion 21 includes two resilient tool-holding members 22 that are symmetrically arranged on the side of the second rack member 20.

Figure 3:
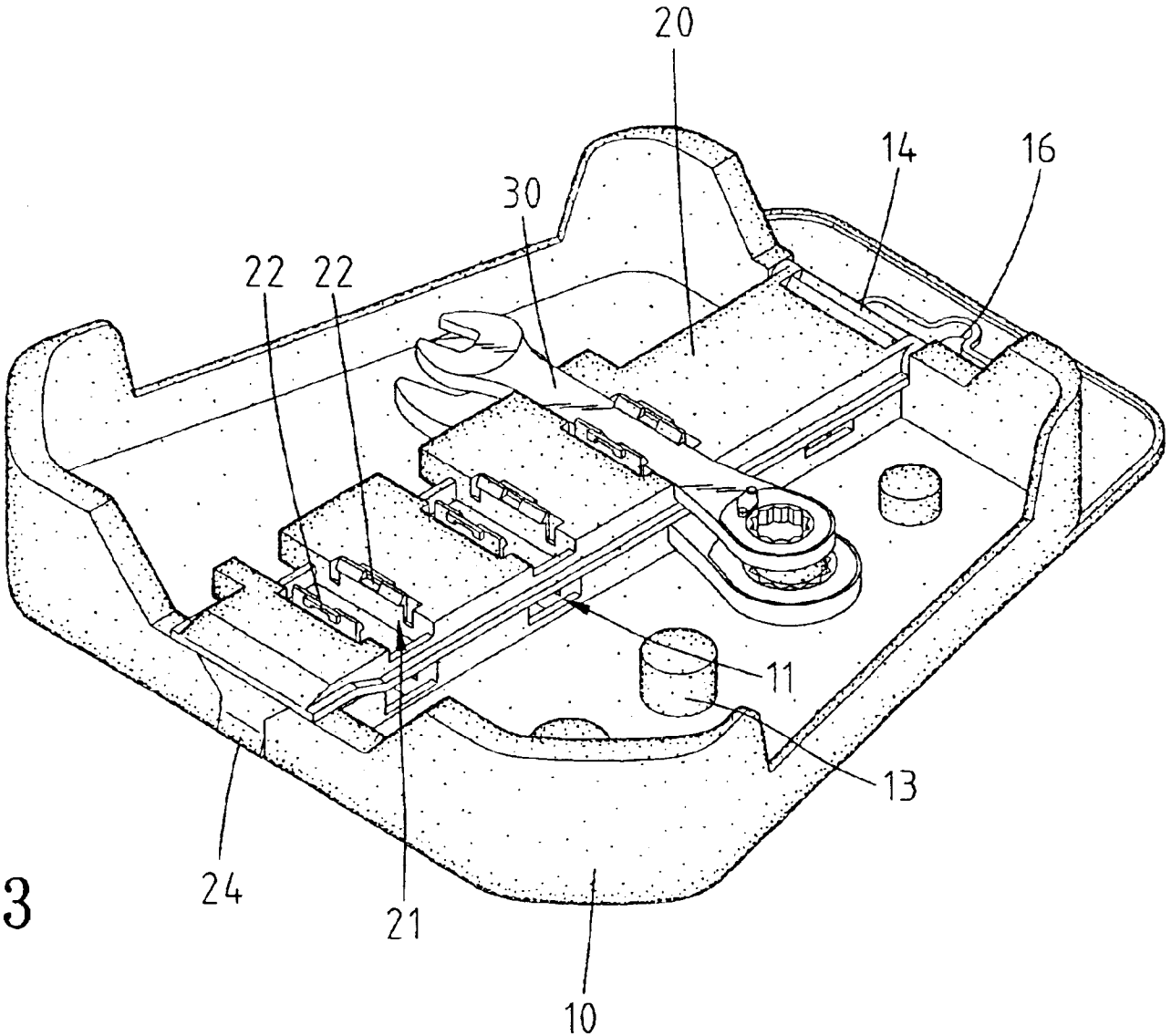
FIG. 3 is a perspective view illustrating use of the tool rack in accordance with the present invention.
Figure 4:
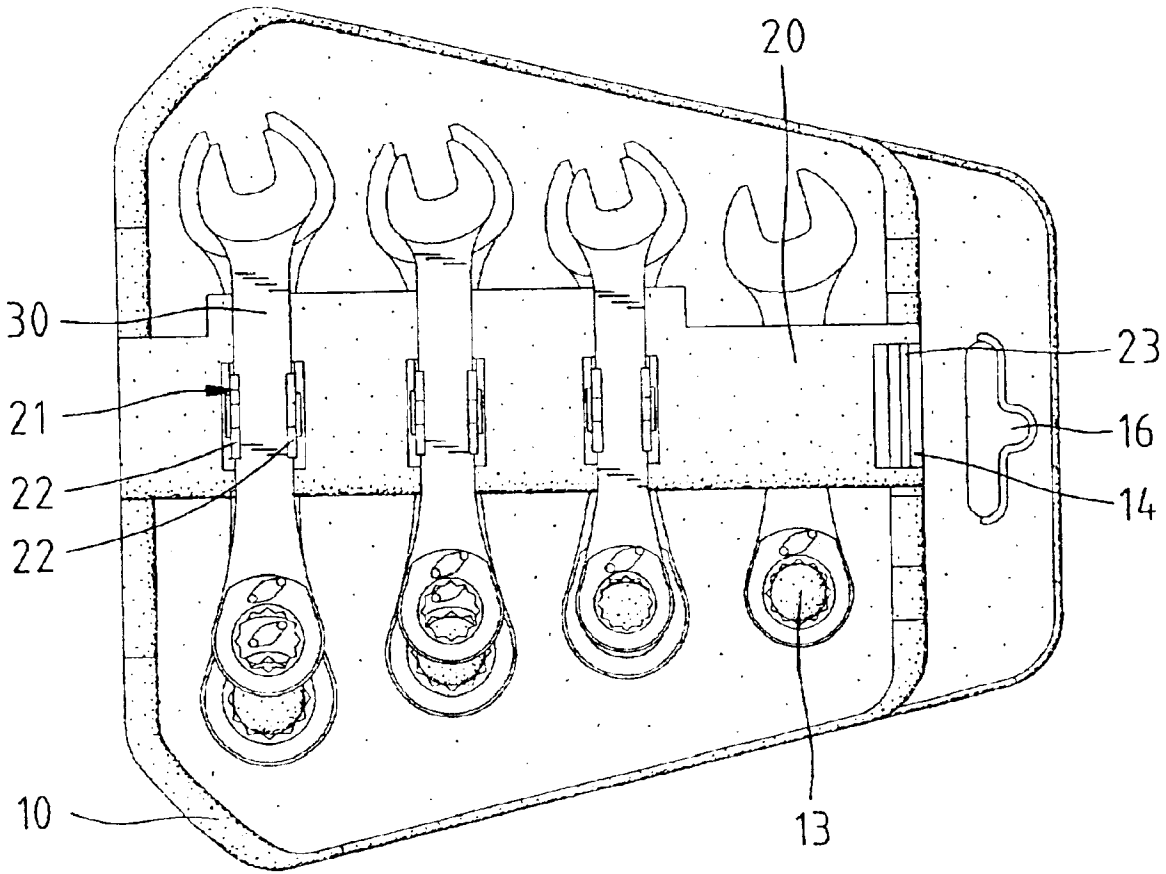
FIG. 4 is a top view of the tool rack in FIG. 3.

As illustrated in FIGS. 3 and 4, the pin 23 on the first end of the second rack member 20 is pivotally engaged in the pivot hole 15 of the pivotal portion 14 of the first rack member 10, with the hook 24 of the second rack member 20 engaged in the groove 17 in the second end of the first rack member 10. When in this state, the second rack member 20 is located above the first rack member 10, thereby saving the space for storing the tools 30. Tools 30 of different sizes can be respectively held by the tool-holding portions 11 and 21 of different sizes through the use of the resilient tool-holding members 12 and 22. A box end (not labeled) of the respective tool 30 can be retained in place by the respective positioning member 13. Thus, the overall area of the tool rack in accordance with the present invention is smaller than that of a conventional tool rack that holds as many tools as the tool rack in accordance with the present invention. The tool rack in accordance with the present invention is thus easy to carry, and the cost for production and transportation is reduced. All of these are due to the two-story design of the rack members 10 and 20 that hold the tools 30.

Figure 5:
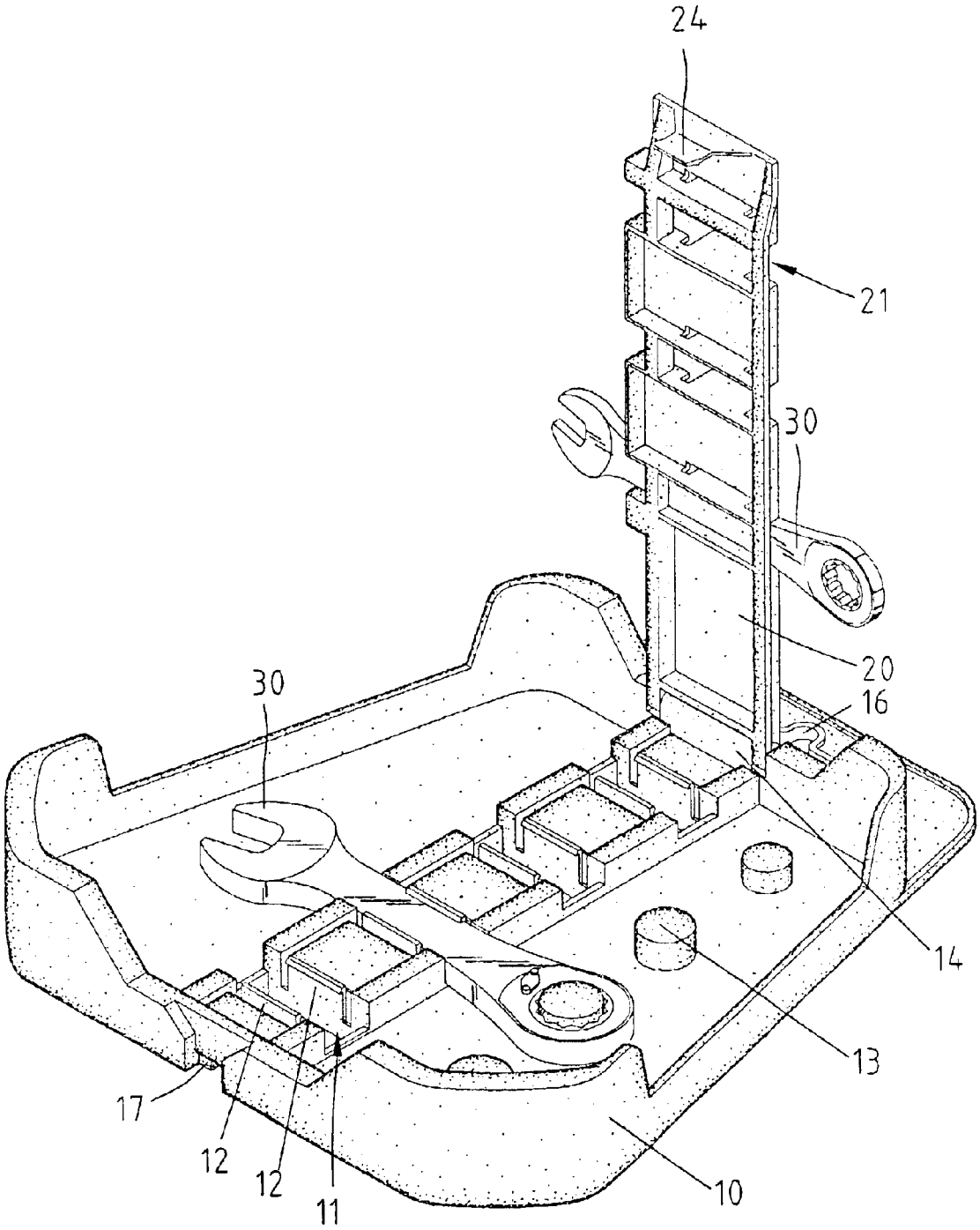
FIG. 5 is another perspective view of the tool rack in accordance with the present invention.

The user may disengage the hook 24 of the second rack member 20 from the groove 17 of the first rack member 10 and then pivot the second rack member 20 to a position shown in FIG. 5, allowing easy storage/retrieval of the tools 30 in/from the first rack member 10.

The tools 30 are held on the side of the second rack member 20 that faces away from the side of the first rack member 10 having the tool-holding portions 11. Preferably, the second rack member 20 has a size that is smaller than that of the first rack member 10.

It is apparently clear that the tool rack in accordance with the present invention is simple in structure, easy to operate, and easy to carry. Further, the tool rack in accordance with the present invention may hold as many as tools as conventional tool racks without increasing the overall area of the tool rack. The cost for production and transportation is reduced.

Although the invention has been explained in relation to its preferred embodiment, it is to be understood that many other possible modifications and variations can be made without departing from the scope of the invention as hereinafter claimed.

What is claimed is:

1. A tool rack comprising:

a first rack member including at least one tool-holding portion on a side thereof, said at least one tool-holding portion of the first rack member being adapted to releasably hold a tool; and a second rack member including an end pivotally engaged with an end of the first rack member, the second rack member including at least one tool-holding portion on a side thereof, said at least one tool-holding portion of the second rack member being adapted to releasably hold a tool wherein the end of the first rack member includes a pivotal portion having a pivot hole that is partially exposed.

2. The tool rack as claimed in claim 1, wherein the end of the second rack member includes a pin pivotally engaged in the pivot hole of the first rack member.

3. The tool rack as claimed in claim 1, wherein another end of the first rack member includes a groove, and wherein another end of the second rack member includes a hook that is releasably engaged in the groove of the first rack member.

4. The tool rack as claimed in claim 1, wherein another end of the first rack member includes a groove, and wherein another end of the second rack member includes a hook that is releasably engaged in the groove of the first rack member.

5. The tool rack as claimed in claim 1, wherein said at least one tool-holding portion of the first rack member and said at least one tool-holding portion of the second rack member include two resilient tool-holding members.

6. The tool rack as claimed in claim 1, wherein the first rack member includes a positioning member formed on the side thereof and aligning with said at least one tool-holding portion of the first rack member.

7. The tool rack as claimed in claim 1, wherein said at least one tool-holding portion of the second rack member is located above said at least one tool-holding portion of the first rack member.

8. The tool rack as claimed in claim 1, wherein the second rack member is located in one of a first position in which the second rack member is securely engaged with the first rack member and a second position without interfering with placement/retrieval of the tool into/from said at least one tool-holding portion of the first rack member.

9. The tool rack as claimed in claim 8, wherein said at least one tool-holding portion of the second rack member is located above said at least one tool-holding portion of the first rack member when the second rack member is in the first position.

10. A tool rack comprising:

a first rack member including at least one tool-holding portion on a side thereof, said at least one tool-holding portion of the first rack member being adapted to releasably hold a tool; and a second rack member including an end pivotally engaged with an end of the first rack member, the second rack member including at least one tool-holding portion on a side thereof, said at least one tool-holding portion of the second rack member being adapted to releasably hold a tool, wherein the end of the second rack member includes a pin for pivotal connection with the end of the first rack member.

11. The tool rack as claimed in claim 10, wherein said at least one tool-holding portion of the second rack member is located above said at least one tool-holding portion of the first rack member.

12. The tool rack as claimed in claim 10, wherein said at least one tool-holding portion of the first rack member and said at least one tool-holding portion of the second rack member include two resilient tool-holding members.

13. The tool rack as claimed in claim 10, wherein the first rack member includes a positioning member formed on the side thereof and aligning with said at least one tool-holding portion of the first rack member.

14. The tool rack as claimed in claim 10, wherein the second rack member is located in one of a first position in which the second rack member is securely engaged with the first rack member and a second position without interfering with placement/retrieval of the tool into/from said at least one tool-holding portion of the first rack member.

15. A tool rack comprising:

a first rack member including at least one tool-holding portion on a side thereof, said at least one tool-holding portion of the first rack member being adapted to releasably hold a tool; and a second rack member including an end pivotally engaged with an end of the first rack member, the second rack member including at least one tool-holding portion on a side thereof, said at least one tool-holding portion of the second rack member being adapted to releasably hold a tool, wherein another end of the first rack member includes a groove, and wherein another end of the second rack member includes a hook that is releasably engaged in the groove of the first rack member.

16. The tool rack as claimed in claim 15, wherein said at least one tool-holding portion of the first rack member and said at least one tool-holding portion of the second rack member include two resilient tool-holding member.

17. The tool rack as claimed in claim 15, wherein the first rack member includes a positioning member formed on the side thereof and aligning with said at least one tool-holding portion of the first rack member.

18. The tool rack as claimed in claim 15, wherein the first rack member includes a hanger hole, allowing hanging of the first rack member.

19. The tool rack as claimed in claim 15, wherein the second rack member is located in one of a first position in which the second rack member is securely engaged with the first rack member and a second position without interfering with placement/retrieval of the tool into/from said at least one tool-holding portion of the first rack member.

20. The tool rack as claimed in claim 19, wherein said at least one tool-holding portion of the second rack member is located above said at least one tool-holding portion of the first rack member when the second rack member is in the first position.

* * * * *